United States Patent [19]

Frentzen et al.

[11] 4,065,953

[45] Jan. 3, 1978

[54] MECHANICAL TUBE EXPANDER

[75] Inventors: Hermann Josef Frentzen, Monchengladbach; Richard Gerretz, Viersen; Ewald Henn, Monchengladbach, all of Germany

[73] Assignee: Mannesmann Aktiengesellschaft, Dusseldorf, Germany

[21] Appl. No.: 742,040

[22] Filed: Nov. 15, 1976

[30] Foreign Application Priority Data

June 15, 1976 Germany ..... 2627172
July 16, 1976 Germany ..... 2632672

[51] Int. Cl.[2] ..... B21D 31/04
[52] U.S. Cl. ..... 72/393; 269/48.1
[58] Field of Search ..... 72/393, DIG. 7; 269/48.1

[56] References Cited

U.S. PATENT DOCUMENTS 1,719,720 7/1929 Olsen ..... 72/393
3,981,172 9/1976 Hess et al. ..... 269/48.1

FOREIGN PATENT DOCUMENTS 581,028 8/1959 Canada ..... 72/393
2,311,735 9/1974 Germany ..... 72/393

*Primary Examiner*—Lowell A. Larson
*Attorney, Agent, or Firm*—Daniel Patch; Suzanne Kikel

[57] ABSTRACT

A mechanical pipe expander for a step-by-step expanding of steel pipes formed with a spiral welded seam. The expander includes an expander head that performs the expanding made up of circumferentially arranged segments over which the pipe assumes a circumjacent position and after which the segments move radially outward to forcibly engage the inside of the pipe. In order to avoid the segments contacting the inside welded seams of the pipe, the segments are formed with one or more complementary spiral slots and if the pipe has cross welded seams with one or more corresponding cross spiral slots.

18 Claims, 7 Drawing Figures

MECHANICAL TUBE EXPANDER

It is well known to employ a mechanical tube expander for a gradual expanding of steel pipe with a tool head consisting of a pyramidal polygon and of segments which are mounted on the surfaces of the polygon and which can be displaced in a radial direction to expand the pipe. The segments are connected to an hydraulic piston cylinder assembly by a hollow boom and the polygon is connected to the piston thereof with the aid of a pull rod installed in the hollow boom. The tube expander consists further of a commonly employed pipe conveying device for a stepwise advancing of a pipe to be expanded. Such pipe expanders are exemplified in U.S. Pat. Nos. 3,583,200 and 2,780,271. Common pipe expanders of this type are applied exclusively for the expanding of steel pipe welded with a longitudinal seam. They are not suitable for the expanding of spiral seam pipes since such pipes have a spiral seam which protrudes inside and, as a rule, a perpendicular seam crossing the spiral seam and connecting two parallel spiral seams. These raised welding seams interfere with the expanding of the pipe. Furthermore, the welding seams prevent an adequate supporting and advancing of the pipe on its outer surface to the expander.

In the light of the above remarks it is the object of the present invention to reconstruct a conventional expander in such a manner that it can be employed to expand spiral seam pipes as well as pipe with straight axial seams and particularly spiral seam pipes having both a spiral weld employed to join its longitudinal edges and one or more spiral welds employed to join the transverse edges of two or more succeeding plates or strips.

The present invention, accordingly, provides for the outer surfaces of the segments of the tool head being equipped with at least one spiral seam slot running helically from the front edge of one segment to the rear edge of another segment, which slot corresponds to a welded seam of a spiral seam pipe, and with a cross seam slot crossing the spiral seam slot in a generally perpendicular direction. In addition, one aspect of the invention provides a pipe conveying mechanism equipped with means for aligning of the seams of the pipes with the seam slot of the tool head. By this construction it is assured that the spiral seam pipe can be expanded mechanically without applying the expansion pressure immediately to the inner protruding welding seams.

According to a further feature of the invention, several spiral seam slots spaced over the circumference of the expander head are provided which can be crossed by a cross seam slot as previously described. Occasionally, the spiral seam pipes are made of especially wide strips or plates. One cross seam slot would not be sufficient in this case, and the invention contemplates, therefore, to distribute two or more cross seam slots over the circumference of the expander head.

When only one spiral seam slot is provided in the expander head, the tool head or pipe to be expanded has to be rotated when the pipe is advanced to establish the proper relationship between the spiral seams and spiral slot. For rotating the pipe the entry mechanism for the pipe, according to the present invention, is equipped with a rotating mechanism for rotating the pipe during its advancing in which the pipe conveying mechanism and rotating device may be interconnected, at least as far as their control is concerned to selectively bring them into and out of operation depending on the mode of feeding being used, i.e., depending on whether a straight feed or rotating feed is needed and to expedite removal of the pipe in a longitudinal direction from the machine after the completion of the last expanding operation.

It is another object of the invention to provide means for rotating the tool head relative to a non-rotating spiral pipe as it is fed to the expander. If desired, the head can be rotated in opposite directions.

According to the invention, when several spiral seam slots are provided, the pipe can be advanced by the entry conveying mechanism without rotation. In this case the slots must be arranged circumferentially around the head in such a manner that the seam of the pipe will coincide with different slots as each succeeding expansion cycle occurs. The pipe expander can be constructed in such a manner that pipe support rolls are installed in series within a prescribed distance from one another for the support and/or for driving the pipe. This distance will allow the pipe to be supported so that at any one time one or more, but not all, of the supporting rolls may be lowered to avoid the rolls contacting the approaching spiral weld. The distance between those rolls should not correspond with the distance, the half distance, or an integral multiple of adjacent pitches rise of the spiral seam of a pipe to be expanded. If desired, the rolls can be lowered independently of each other to avoid the seam hitting the rolls.

This form of construction can be augmented with a control device automatically controlling those functions of the expander that come into play with regard to the proper initial feed of the pipe, the proper location of the spiral seam relative to the slots of the head, and the proper and timely lowering of the pipe support rolls and the boom supports.

According to the present invention, the pipe support rolls can also be lowered by providing sensing elements which will scan the pipe's outer surface and respond to a passing welding seam and activate the lowering mechanism for the rolls.

For the support of the expander head itself, the invention provides that the hollow boom be equipped with at least two supporting rolls arranged in a tandem fashion which can be retracted independently of one another by an automatic control means.

The starting of the pipe expander operation is made easier by the present invention providing a device for the prealigning of a pipe to be expanded which allows the pipe to be positioned to correspond to a multiple of the steps of expanding the pipe before the first step of expansion.

These features of the present invention as well as others will be better appreciated when the following description of several preferred embodiments thereof are read along with the accompanying schematic drawings of which:

Figure 1:
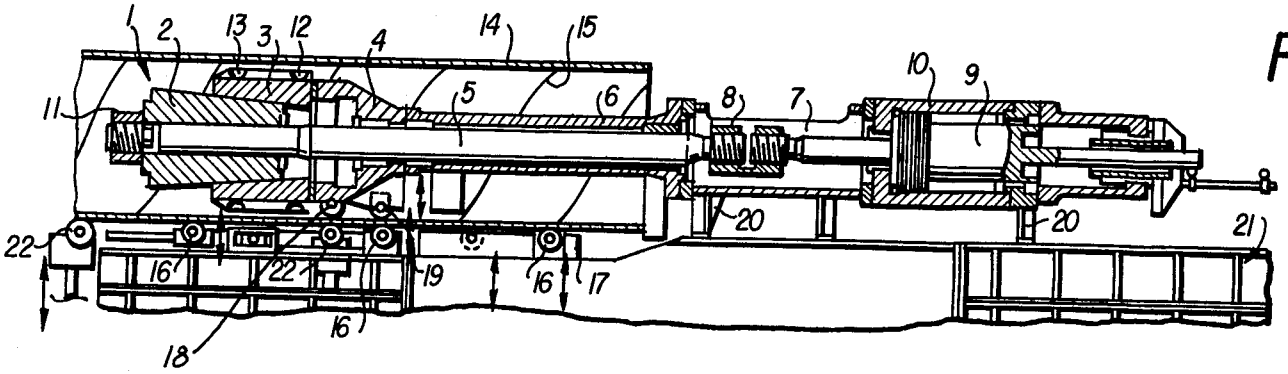
FIG. 1 shows a sectional view of a mechanical pipe expander built in accordance with the present invention.

FIG. 1 illustrates a mechanical pipe expander for a section by section expansion of a steel pipe 14 having a spiral type weld seam 15 and a cross weld seam, not shown. The expander is equipped with a tool head 1 consisting of a pyramidal polygon 2 and segments 3 displaceable in a radial direction and mounted on the surfaces of the polygon in accordance with well-known practice. The segments 3 are connected on a hollow boom 6 with the aid of a spacer 4, the boom, in turn, being connected to the cylinder of an hydraulic displacing device 10. The piston 9 of the hydraulic displacement device 10 is connected with a pull rod 5 installed in the hollow boom 6 with the aid of a corresponding lock 8. The pyramidal polygon 2 is connected to the pull rod 5 by the aid of a nut 11. The hydrualic displacement device 10 and a housing 7 connecting it with the hollow boom 6 are mounted on a supporting frame 21 with the aid of supports 20. These supports 20 do not interfere with the pipes advancing step-by-step over the housing 7 and device 10. As noted above, the construction and operation of these elements are all well known.

Below the expander head 1 rolls 16 and 22 are provided serving as supports for the pipe 14 and without contacting the spiral seam 15 in which the rolls 16 serve only for the straight advance and return of the pipe 14 so that they are mounted on swingable levers 17, which lower the rolls progressively as the seams pass over them. The rolls 22 are arranged in parallel pairs at a slight angle and cause a rotation of the pipe 14 when a helical feed is used during the initial feeding of the pipe to the machine and in subsequent intermittent feed of the pipe. The rolls 16 and 22 are arranged alternatively in which the rolls 16 serve primarily for a quick feeding of a new pipe and its quick return while the rolls 22 cause primarily the rotary advancing. The separate groups of rolls 16 and 22 are interrelated and can be raised and lowered as a unit, and also each or all individually as indicated by an arrow in FIG. 1. The rolls are also adjustable in an axial direction relative to the pipe and, preferably, in an indpendent manner. This conveying device has, therefore, the advantage of a transport service which can be switched very simply from one type of advancing mode to the other, i.e., made to switch from straight advancing mode to the other, i.e., made to switch from straight advancing of the pipe 14 to a rotary advancing by just pushing a botton, if desired. Two supporting rolls 16 and 22 arranged in tandem and such that roll 16 can be retracted. These rolls serve together as support for the expander head 1. The supporting roll 18 is installed diagonally. As with the expander itself, the support arrangement of the head is well known in the art.

Figure 2:
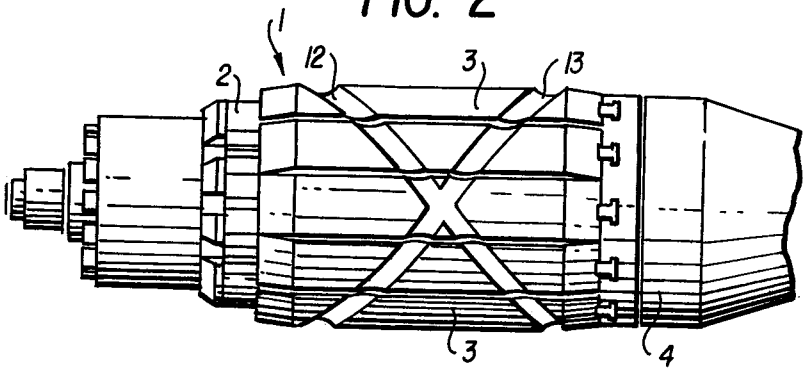
FIG. 2 shows a plan view of the expander head illustrated in FIG. 1.

One of the features of the present invention is to provide the segments 3 of the expander head 1 with a spiral seam slot 12 and with a cross seam slot 13 which extends perpendicularly across the spiral seam slot. the course of these slots is shown in detail in FIG. 2, where they range over several segments 3. The helix of the spiral seam may be of either a right hand spiral or a left hand spiral, in either case the cross seam slot would be essentially of opposite hand.

In counterdistinction to longitudinal seam welded pipe discussed in the aforesaid U.S. patents, the seam or seams of a spiral welded pipe form parallel running seams which seams at spaced intervals may be joined with cross welds. These cross welds actually are the result of the joining of the adjacent ends of the steel strip or plates prior to the formation of the pipe. The seam slots 12 and 13 in FIGS. 2 and 3 are constructed to accommodate the corresponding seams of the pipe during the expansion thereof.

Figure 3:
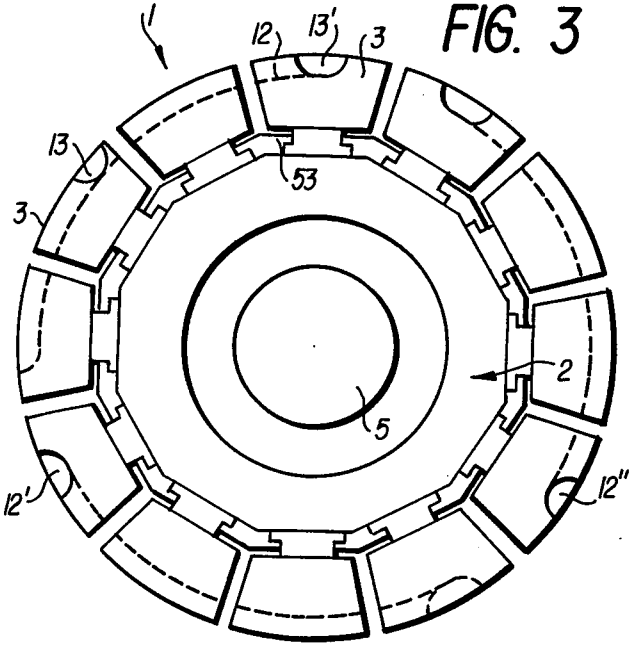
FIG. 3 shows a front view of the aforesaid expander head.

FIG. 3 illustrates three spiral seam slots 12, 12' and 12'' which are evenly distributed over the circumference of the expander head 1 or, more particularly, the segments 3. The cross seam slot 13 can be seen, too, as well as the spiral seam 15 of the pipe which can also be seen in FIG. 1. FIG. 3 indicates the T-shaped members at 53 of the head 1.

Figure 4:
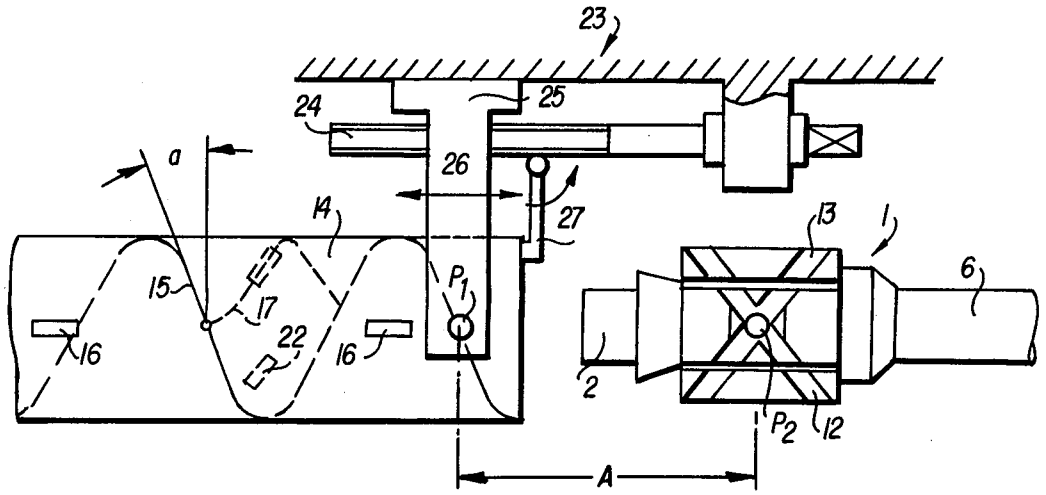
FIG. 4 shows a control arrangement for the prealigning of a seam of a pipe and the end of the pipe with the aforesaid expander head.

When a pipe is brought to the machine to be expanded, it is prealigned with the expander head 1 in such a manner that the spiral seam 15 is positioned to coincide with the spiral seam slot 12. This operation is accomplished by a device 23 best shown in FIG. 4. The device 23 includes a positioning arm 25 which is adjustable in the directions indicated by an arrow 26, with the aid of an adjusting spindle 24, in such a manner that the distance of the point P1 from the fixed cross point of P2 of the slots 12 and 13 corresponds to a value A which is a function of the pipe diameter, the angle of rise "*a*", and on other machine constants. This setting will not be changed for pipes having the same dimensions. A pipe 14 to be expanded is then advanced against a swingable stop 27 and rotated until the spiral seam 15 is positioned below the point P1. The distance A defines the distance of advance for the first step movement to perform the first expanding operation in which the seam or seams will be correctly positioned relative to the slot or slots of the segments. A sensor for the pipe end can be provided instead of the swingable limit stop 27 which will indicate the position of the pipe as soon as the welding seam 15 comes to a position below the point P1 during the straight advancing of the pipe. In this second case a computer can serve for the further positioning of the pipe 14, in order to establish the proper value for A of FIG. 4, which is necessary for the starting of the expanding process.

Generally, two forms of operation are possible with the disclosed tube expander of FIGS. 1–4. In case there is only one spiral seam slot provided in the head 1 the pipe can be rotated during its advance by steps and the spiral seam will always be positioned over the spiral seam slot 12. When several spiral seam slots 12, as shown in FIG. 3, are provided in the head 1, the pipe can be advanced without rotation in which the advance is coordinated in such a manner that the spiral seam rests first in the spiral seam slot 12, then at the next step in the spiral seam slot 12', and at the third step in the spiral seam slot 12''. In the manufacture of extremely large pipe the head may be provided with more than one cross seam slot, such as slots 13 and 13', shown in FIG. 3.

Figure 5:
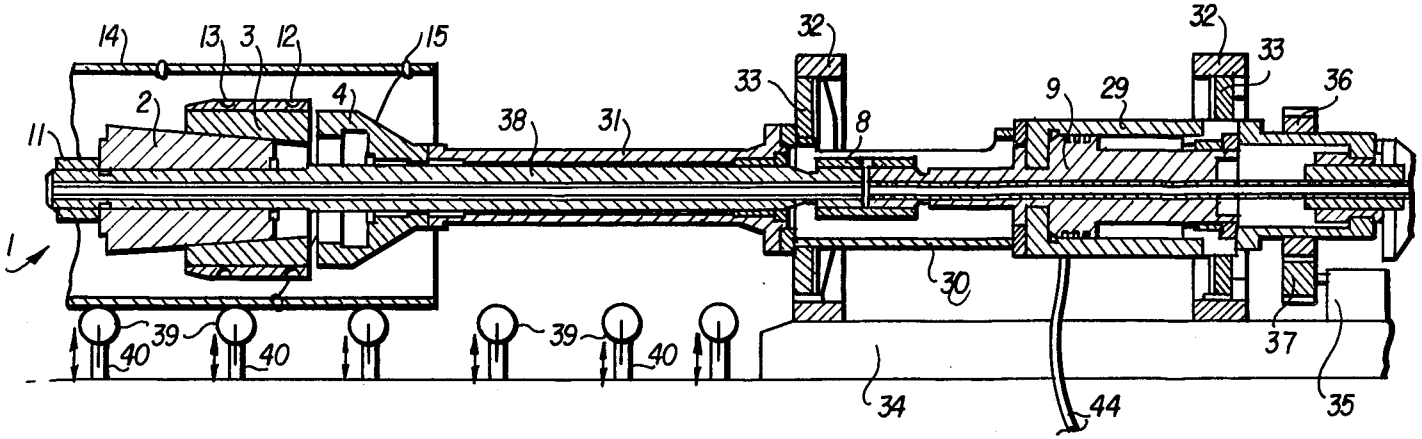
FIG. 5 illustrates a longitudinal sectional view of a second embodiment of the present invention.

In turning now to the second embodiment of the present invention illustrated in FIG. 5 where appropriate similar reference numbers have been used from FIG. 1 and although not shown, the spacer 4 may have rolls similar to rolls 18 and 19 of FIG. 1. This particular form of construction is equipped with a revolvable cylinder 29 having a housing 30. Two bearing assemblies 32 are provided for rotatably supporting the cylinder which include corresponding ring bearings 33. At least one of the bearing assemblies 32 is constructed in such a manner that it is able to withstand axial forces and to transfer those into a support and, hence, into a supporting frame 34 in order to avoid a displacement of the entire tube expander. A motor 35 rotates the expander head 1. This motor drives a gear wheel 36 connected to the cylinder 29 and is rotated by a pinion 37 so that the entire tool head 1 is rotated with the cylinder 29 along with the hollow boom 31 and pull rod 38. The expander is rotated and the pipe 14 to be expanded is advanced in steps after each operation of expansion. When the pipe is advanced in a straight manner line with the aid of driven rolls 39 which are supported by vertical adjustable mechanisms 40, the rolls 39 can be progressively lowered as soon as the spiral seam 15 comes close to them as the pipe is advanced towards the expansion head 1.

Figure 6:
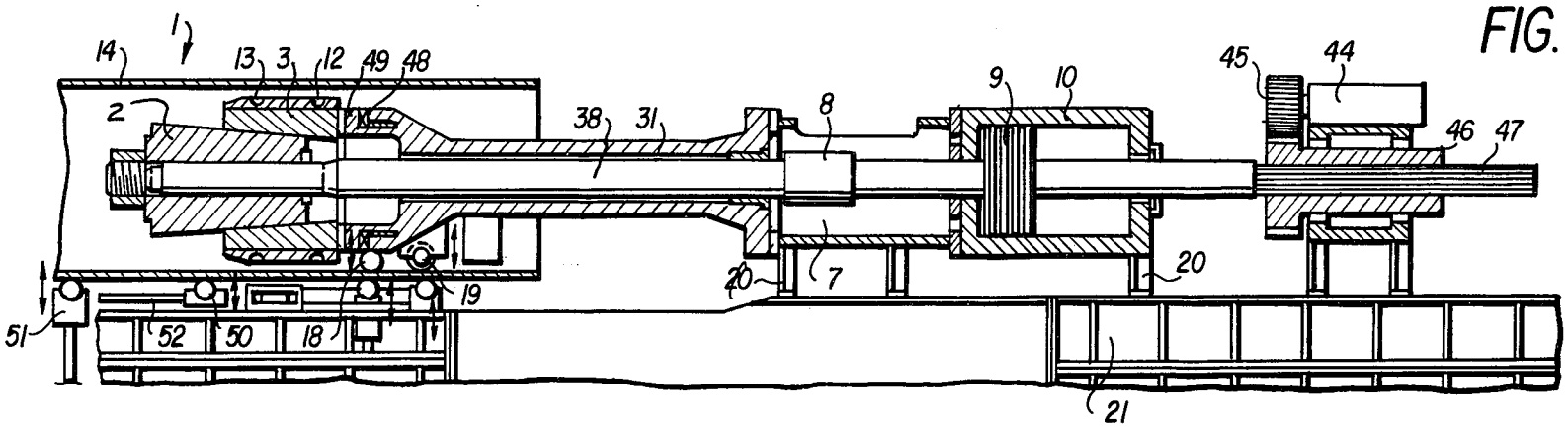
FIG. 6 illustrates a longitudinal sectional view of a third embodiment of the present invention.

The form of construction according to FIG. 6 is distinguished from the one according to FIG. 5 inasmuch as that only the pull rod 38 and by it the tool head 1 is rotated in a controlled manner. A driving motor 44 rotates the pull rod 38. A driving pinion 45 of the driving motor 44 drives a gear sleeve 46 in which the piston rod 47 can be rotated and allowed to move axially with the aid of an outside spline provided on the end of the piston rod. The rotation of the piston rod 47 is transferred to the pull rod 38 with the aid of the lock 8. The pull rod, in turn, is connected to the pyramidal polygon 2 and imparts its rotation to the segments 3. An axial bearing 48 is provided between the intermediate piece 49 to allow for the rotary motion of the tool head 1 against the hollow boom 31. Rolls 50 provided for the conveyance of the pipe tube 14 to be expanded are mounted alternately on vertical adjustable mechanisms 51 which can be lowered and raised toward and away from the pipe by swingable arms 52 and may be adjusted axially with respect to the pipe. FIG. 6 also shows rolls 18 and 19 installed immediately in the area of the expander head for supporting the expander head 1, and cooperating rolls between them which can be retracted alternately, as explained above.

Figure 7:
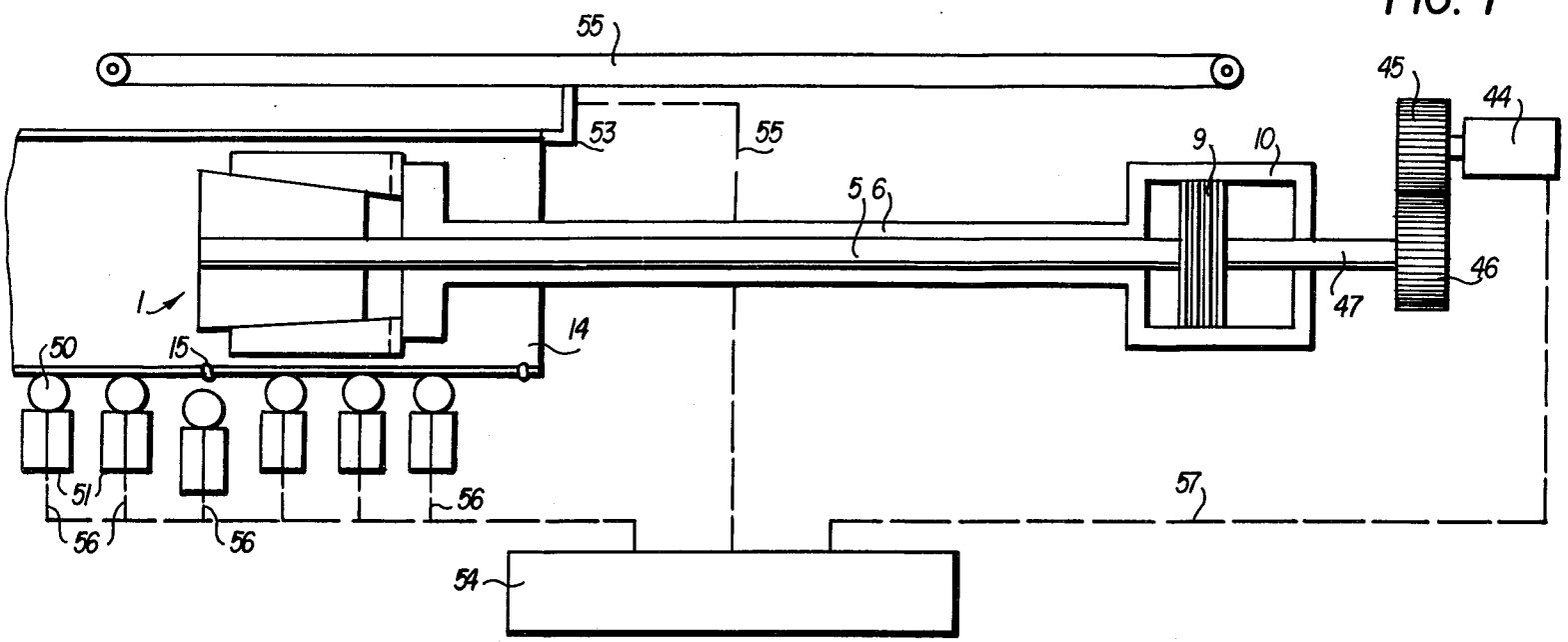
FIG. 7 is a control arrangement for prelining an expander head with a seam of a spiral seam pipe and for controlling the lowering of the pipe support rolls.

With reference to FIG. 7 there is shown a control device for a mechanical tube expander constructed according to FIG. 6. The main elements of this control device comprise a position sensing element 53 for the pipe and a control device 54, preferably a computer type. The position sensing element 53 is fastened on a continuous carrier belt 55. By this means it can be positioned to find the front end of a pipe 14 to be expanded and transmit its position to the control device 54. The control device will activate the motor 44 for rotating the piston rod 47 and thereby cause a controlled rotation of the tool head 1 along with the control of the position of the vertical adjustable mechanism 51 which can be lowered for the purpose of lowering the rolls 50 according to a specified program. Each roll 50 will be lowered by operating the corresponding adjustable mechanism 51 when the spiral seam 15 progressively approaches each roll. A transmitter cable 55 and control cables 56 and 57 are indicated by dotted lines in FIG. 7.

It will be noted that in each of the embodiments described above that conventional pipes with an axial straight weld can be handled which along with a change of the segments 3 to accommodate the conventional welded pipe, the rolls 22 will be rendered inoperative and the pipe will be supported by the rolls 16.

In accordance with the provisions of the patent statutes, we have explained the principle and operation of our invention and have illustrated and described what we consider to represent the best embodiment thereof.

We claim:

1. A mechanical expander for an elongated metallic pipe formed with an inside welded spiral seam and with an inside welded cross seam, comprising:

an expandable head constructed to allow a pipe to assume a circumjacent relationship therewith, said head including an outer working surface, means for displacing said working surface relative to the circumjacent pipe to impose an expanding force on the inside of the pipe, a first spiral slot in said working surface formed and arranged to coincide with the welded spiral seam of the pipe, and a second spiral slot in said working surface formed and arranged to coincide with the welded cross seam of the pipe.

2. A mechanical expander in accordance with claim 1 wherein said working surface includes at least two of said spiral slots which are spaced in a parallel spiral manner around said head so as to present themselves with respect to the welded spiral seam of the pipe that alignment of the spiral seam with alternate slots is obtained on succeeding expansion operations.

3. A mechanical expander in accordance with claim 1 further comprising:

a conveying means for bringing a pipe to the expander for expansion thereby, said conveying means including:

means for positioning the conveyed pipe relative to said expander to obtain a proper circumjacent position therewith.

4. A mechanical expander in accordance with claim 3 wherein said conveying means comprises a number of pipe supporting rolls arranged along the longitudinal axis of the pipe wherein said rolls are spaced apart so as to not correspond to the distance or integral multiple of the rise of the welded spiral seam of the pipe, and a means for moving said rolls at least one independently of the other toward and away from a pipe supported thereby.

5. A mechanical pipe expander in accordance with claim 4, including means for adjusting said rolls axially of said pipe.

6. A mechanical expander in accordance with claim 1, including a control means, said control means having means for detecting the entering end of the pipe as the pipe is brought to the expander, means for positioning the pipe in response to said detection to establish a desired distance in an axial direction of the pipe between the pipe and the head of said expander.

7. A mechanical expander in accordance with claim 4, including a sensor means for determining the presence of a pipe brought to said expander by said rolls, and means for effecting vertical moving of said rolls progressively in order to avoid the rolls coming in contact with the welded seams.

8. A mechanical expander in accordance with claim 1 wherein said expander includes a support member, said support member comprising at least one support element arranged to contact said head until the pipe approaches said element, means for moving said element toward and away from the support contact with said head, and control means including a computer for detecting the approach of the pipe and for effecting operation of said means for moving said element.

9. A mechanical expander in accordance with claim 1 including means for aligning the pipe in an axial direction relative to said expander head so that the pipe can be positioned entirely or progressively over said head as a function of the working surface length of said head.

10. A mechanical expander in accordance with claim 1 including means for rotating said head about the longitudinal axis of the pipe.

11. A mechanical expander in accordance with claim 10, said means for rotating said head including means for rotating the head in a clockwise and counterclockwise direction.

12. A mechanical expander in accordance with claim 10, said expander including a piston cylinder assembly for effecting expansion of said working surface.

means for mounting said cylinder of said piston cylinder assembly for rotation about the longitudinal axis of said piston cylinder assembly, and means for rotating said cylinder.

13. A mechanical expander in accordance with claim 10 wherein said expander includes a piston cylinder assembly for expanding said working surface, means for supporting the piston of said piston cylinder assembly to allow rotating of said piston relative to the stationary cylinder thereof to thereby effect rotation of said head.

14. A mechanical expander in accordance with claim 10 including control means for controlling the angle of rotation of said head so that the spiral slot will coincide with the spiral seam of the pipe.

15. A mechanical expander in accordance with claim 1 wherein said second spiral slot is arranged substantially normal to said first spiral slot and crosses said first spiral slot.

16. A mechanical expander for an elongated metallic pipe formed with an inside welded spiral seam and with an inside welded cross seam, comprising:

an expandable head constructed to allow a pipe to assume a circumjacent relationship therewith, said head including an outer working surface, means for displacing said working surface relative to the circumjacent pipe to impose an expanding force on the inside of the pipe, one or more first spiral slots in said working surface formed and arranged to coincide with the welded spiral seam of the pipe, one or more second spiral slots in said wporking surface formed and arranged to coincide with the welded cross seam of the pipe, means for positioning the pipe and said expander, one relative to the other and for aligning the pipe so that the pipe seams, when circumjacently positioned on the head will fall directly over the corresponding slots of said working surface.

17. A mechanical expander in accordance with claim 2 wherein said working surface includes at least two slots which are spaced in a parallel spiral manner around said head so as to present themselves with respect to the continuous welded spiral seam of the pipe that alignment of the spiral seam with alternate slots is obtained on succeeding expansion operations.

18. A mechanical expander in accordance with claim 16 wherein said means for positioning the pipe includes means for advancing the pipe to said expander head with little or no rotation of the pipe for expansion thereby.

* * * * *

UNITED STATES PATENT AND TRADEMARK OFFICE

CERTIFICATE OF CORRECTION

PATENT NO. : 4,065,953
DATED : January 3, 1978
INVENTOR(S) : Hermann Josef Frentzen and Ewald Henn It is certified that error appears in the above-identified patent and that said Letters Patent are hereby corrected as shown below:

Column 3, line 47, indpendent should read --independent--.

Column 3, lines 50 & 51, the phrase, "i.e., made to switch from straight advancing mode to the other," should be deleted.

Column 3, line 63, ". the" should read -- . The --

Claim 16, line 17, wporking, should read --working--.

Claim 17, line 2, dependency should be 16 instead of "2".

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*